United States Patent [19]

Hincks et al.

[11] Patent Number: 4,465,306

[45] Date of Patent: Aug. 14, 1984

[54] COMBINATION CHECKWRITING AND BOOKKEEPING ASSEMBLY AND METHOD OF USING SAME

[75] Inventors: Robert W. Hincks; Daniel A. Hincks, both of Farmington, Conn.

[73] Assignee: Data Management, Inc., Farmington, Conn.

[21] Appl. No.: 351,223

[22] Filed: Feb. 22, 1982

[51] Int. Cl.[3] ..... B41L 3/00; B42B 5/00; B42C 1/00

[52] U.S. Cl. ..... 282/29 B; 281/45

[58] Field of Search ..... 282/29 B, 29 A, 29 R; 281/45

[56] References Cited

U.S. PATENT DOCUMENTS

| | | | |
|---|---|---|---|
| 2,338,553 | 1/1944 | Straus | 282/29 B |
| 2,494,142 | 1/1950 | Pfeiffer et al. | 282/29 B |
| 3,236,542 | 2/1966 | Russell | 282/29 B |
| 3,498,640 | 3/1970 | Russell | 282/29 B |
| 3,645,561 | 2/1972 | Kendall | 281/45 |
| 3,722,922 | 3/1973 | Perez | 282/29 B |

*Primary Examiner*—E. R. Kazenske
*Assistant Examiner*—Paul M. Heyrana, Sr.

[57] ABSTRACT

A one-write bookkeeping and check writing system has a bank of shingled checks with voucher stubs retentively held by a peg board in overlying registration with a journal sheet. An employee record card for the entry of employee earnings data is folded about one of two fold lines and removably interposed between the bank of checks and the journal sheet with the voucher stubs in registration with the journal sheet. The back side of the record card has a transfer coating to transfer data entered on the voucher stub to the underlying journal sheet. The folded under portion of the record card provides a barrier to the transfer of data other than the data entered on the voucher stub.

17 Claims, 4 Drawing Figures

COMBINATION CHECKWRITING AND BOOKKEEPING ASSEMBLY AND METHOD OF USING SAME

BACKGROUND OF THE INVENTION

This invention relates to a combination check writing and bookkeeping assembly and more particularly to a novel one-write bookkeeping and check writing assembly for the issuance of payroll and disbursement checks wherein a limited amount of the information being entered on the check is simultaneously entered on the ledger sheet and on an employee record card.

Bookkeeping ledger systems require the entry of information concerning each issued check so that a complete record of disbursements is readily apparent. Frequently, this requires the entry of data on the check and the subsequent recording of that data onto a journal sheet, thus requiring a two-step operation and an opportunity for error to be made with respect to the numerical value of the check, the number of the check, etc.

In the situation of payroll checks as opposed to disbursement checks, there is an additional recording step of entering certain employee payroll data including earnings data into a separate employee record commonly referred to as an employee payroll card or employee record card. Employee earnings data usually includes the employee's gross earnings, FICA withholding, withholding tax, and the net amount of the check. Such employee earnings data may be entered on a voucher stub attached to the check and thereafter entered on the employee record card. Aditional employee payroll data includes hours of regular time, hours of overtime, amount of pay for regular time, and amount of pay for overtime work.

Previously it has been proposed to employ shingled checks in connection with a special base sheet and binder so that entry of data on the check will transfer the data onto the underlying ledger sheet, i.e., one-write bookkeeping systems. For this purpose, the shingled checks are provided with localized carbonized or "carbonless" coatings and U.S. Pat. No. 3,236,542 to Russell is indicative thereof. Prior attempts to utilize such assemblies for payroll check writing have generally required the use of multiple empolyee record cards for a one year period when "carbonless" record cards were utilized. Other attempts have required a sheet of carbon paper positioned between the employee record card and the ledger sheet.

It is an object of the present invention to provide a novel and improved one-write bookkeeping and check writing system for disbursement and payroll checks which enables simultaneous entry of employee earnings data onto the voucher stub and onto both the underlying disbursement and payroll journal sheet and the employee record card.

It is also an object to provide such a system wherein a single employee record card can be used for a one year period.

Another object is to provide such a system wherein carbonless coatings are utilized for transfer of data from the employee record card to the disbursement and payroll journal sheet.

A further object is to provide a bookkeeping and check writing system which is relatively simple to fabricate and utilize, and which enables simultaneous entry of payee and numerical amounts onto the check and onto underlying bookkeeping documents.

Still another object is to provide such a system wherein the employee record card provides a barrier to prevent the transfer to the journal sheet of data entered on the employee record card other than employee earnings data.

A further object is to provide such a system wherein all of the components fit compatibly into standard ledger ring binders.

A further object is to provide a method of one-write check writing and bookkeeping wherein disbursement and payroll checks and records thereof are simultaneously prepared and which method is simple and rapid so as to minimize the time required and the possibility of error.

A still further object is to provide such a method in which checks and vouchers may be made out concurrently with simultaneous entries into the journal sheets and employee payroll record cards.

SUMMARY OF THE INVENTION

It has now been found that the foregoing and related objects can be readily attained in a one-write bookkeeping and check writing system by a combination including a bank of shingled commercial checks with each check having a detachable payroll voucher stub at one side thereof. The front surface of each check has a discrete area thereon for the entry of at least the name of the payee and the amount of the check. On the back surface of each check is a corresponding discrete area of an indicia transfer coating. Each of the voucher stubs has a discrete area on its front surface for the entry of employee earnings data and a corresponding discrete area of an indicia transfer coating on the back surface.

A disbursement and payroll journal sheet underlies the bank checks and has length and width dimensions with the width dimension being divided into a multiplicity of columns and the length dimension being divided into a multiplicity of lines. A first portion of the columns of the journal sheet are dimensioned and configured cooperatively with the shingled commercial checks to record at least the name of payee and the amount entered on the check. A second portion of columns of the journal sheet are dimensioned and configured cooperatively with the payroll voucher stubs to record employee earnings data. A spatial correlation means detachably mounts the journal sheet and the bank of shingled checks in overlying relationship with the discrete area of the checks in alignment with the first portion of the columns of the journal sheet and the discrete area of the voucher stubs in alignment with the second portion of the columns of the journal sheet.

An employee record card for entry of employee related information including employee earnings data for a yearly period is removably interposed between the journal sheet and the bank of checks. The front surface of the employmee record card has a first section along one side thereof for recording employee earnings data for a first six month period and second section along the other side thereof for recording employee earnings data for a second six month period. A middle section is provided for the entry of employee personnel information. The first and second sections each have a multiplicity of lines corresponding to the lines of the journal sheet and the vertical spacing of the shingled checks, and at least a portion of the width of each section provides a multiplicity of columns dimensioned and configured cooperatively with the voucher stubs to record employee earnings data entered on the voucher stubs. The record card is folded along a first vertical line spaced from the first section thereof to interpose the folded portion between the remainder of the record card and the journal sheet. A second vertical fold line is located along a line spaced from the second section.

The record card includes means for aligning the columns of the first section thereof in overlying registration with the second portion of columns of the journal sheet and being so aligned with the journal sheet. The record card also includes means for aligning the columns of the second section thereof in overlying registration with the second portion of columns of the journal sheet when the record card is unfolded along the first fold line and folded about the second fold line. The record card has indicia transfer means on the back surface thereof for transferring the employee earnings data entered on the discrete area of the voucher stub to the second portion of the columns of the journal sheet. The folded under portion of the card disposes a portion of the front surface of the folded card against the front surface of the journal sheet to prevent transfer to the journal sheet of entries on the record card other than employee earnings data entered on the discrete area of the voucher stub. In use, entry of employee earnings data on the discrete area on the front surface of a selected voucher stub simultaneously records that information on the record card within the columns of the first section of the record card and on the journal sheet within the second portion of the columns of the journal sheet.

In the preferred embodiments, the record card has first and second opposing vertical side edges and the portion of the first section of the record card which has a multiplicity of columns is bounded by an inner and outer vertical edge boundary. When the record card is folded about the first fold line, the first edge of the record card is aligned under the inner edge boundary of such portion of the first section. Further, the portion of the second section of the record card which has a multiplicity of columns is bounded by an inner and outer vertical edge boundary and the second edge of the record card is aligned under the inner edge boundary of the second section when the record card is unfolded along the first fold line and folded about the second fold line.

Desirably, the indicia transfer means on the back surface of the record card is a first reactant coating cooperating with a second reactant coating on the front surface of the journal sheet so that the coatings are activated by pressure of a writing implement to effect a transfer of the data entered on the voucher stub onto the journal sheet. Conveniently, the indicia transfer coating on the back surface of the checks and the voucher stubs is a carbonized coating.

The first fold line of the record card is spaced from the middle section of the record card so that the middle section and the first section are upwardly facing when the card is folded about the first fold line and removably interposed between the bank of checks and the journal sheet. The second fold line is spaced from the middle section so that the middle section and the second section are upwardly facing when the record card is unfolded about the first fold line and folded about the second fold line and removably inserted between the bank of checks and the journal sheet.

In using the one-write combination payroll and disbursement check writing system, the method for simultaneously writing a check with a voucher stub portion and recording selected voucher data on both the disbursement and payroll journal sheet and on an employee record card involves positioning the check with voucher stub portion to be written in overlying registration with the disbursement and journal sheet to allow entry of data on the check and voucher stub portion.

An employee record card is provided for the entry of employee related information, including selected voucher stub portion data for a yearly period, on its upper surface. The record card has a first columnar section dimensioned cooperatively with the voucher stub portion for recording the selected voucher stub portion data for one six-month period, a second columnar section dimensioned cooperatively with the voucher stub portion for recording selected voucher stub portion data for a second six-month period, and a middle section for entry of employee personnel information.

The employee record is folded about a first fold line on the upper surface which is associated with the first columnar section. The folded record card is positioned between the check to be written and the journal sheet, and the first columnar portion is aligned beneath the voucher stub portion so that entry of selected data on the voucher stub portion is simultaneously transferred by the discrete area tranfer means to the first columnar section of the record card for recording thereon. Selected data is entered on the voucher stub portion with a writing implement and is simulataneously entered on the first columnar section of the record card and the respective columnar voucher portion of the journal sheet.

The folded record card is removed from between the check and journal sheet, and the check is maintained in overlying direct registration with the journal sheet during the entry of selected data on the check. During the entry of selected data on the check and on the voucher stub portion, all other checks are displaced to an inoperative position spaced from the employee record card and the journal sheet.

DETAILED DESCRIPTION OF THE ILLUSTRATED EMBODIMENT

Figure 1:
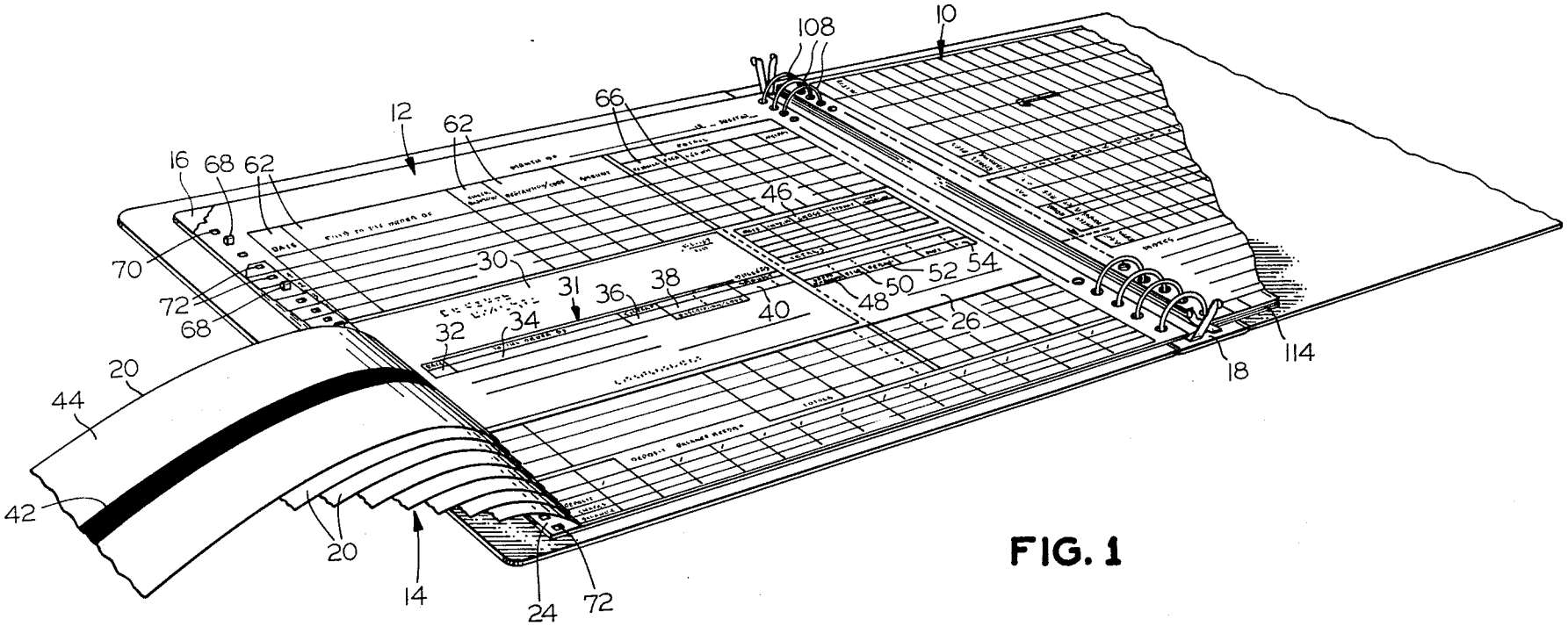
FIG. 1 is a fragmentary perspective view of a one-write bookkeeping and check writing system embodyng the present invention with the disbursement and payroll journal sheet and the bank of checks mounted on a pegboard assembled in a ring binder, and with the shingled checks not being used shown in phantom line in a inoperative position.

In the attached drawings, there is illustrated a one-write bookkeeping and check writing system embodying this invention for the writing of checks with voucher stubs and the simultaneous recording of the information on the related bookkeeping document. The system is generally comprised of an employee record card generally designated by the numeral 10, a disbursement and payroll journal sheet generally designated by the numeral 12, a bank of shingled checks generally designated by the numeral 14, a peg board member generally designated by the numeral 16, and a ring binder generally designated by the numeral 18.

As can be seen in FIG. 1, the bank of checks 14 is comprised of a plurality of commercial checks 20 bound in shingled overlapping relationship. Each check 20 is attached at one end to edge binder portion 24 of the bank 14. A payroll voucher stub portion 26 extending along the other end of each check 20, and a line of transverse perforations 23 is provided for easy severance of the voucher stub portion 26 from the body of the check. Likewise, a line of transverse perforations 25 is provided for easy severance of the body of each check from the binder portion 24.

The front surface 30 of each check has a discrete area generally designated by the numeral 31 for the entry of data for issuing a check including a space 32 for the date of the check, a space 34 for the name of the payee, a space 36 for the check number, a space 38 for a description code, and a space 40 for the amount of the check. A discrete area 42 of transfer coating is correspondingly located on the back surface 44 of each check, such as a carbon coating to effect transfer of data entered on the check onto the underlying sheet.

The voucher stub portion 26 is similarly designed with its front surface 46 having a discrete area generally designated by the numeral 47 for the entry of employee earnings data including a space 48 for gross earnings, a space 50 for FICA withholdings, a space 52 for income tax withholdings, and a space 54 for the net amount of the check. A discrete area 56 of an indicia transfer coating is correspondingly located on the back surface 58 of the voucher stub portion.

Turning now in detail to the journal sheet 12 as seen in FIG. 1, it has its width dimension divided into a multiplicity of columns and the length dimension divided into a multiplicity of lines. A first portion of these columns is comprised of columns 62 which are dimensioned and configured cooperatively with the spaces 32–40 of the discrete area 31 of check 20 to record the data entered thereon. A second portion of columns of journal sheet 12 is comprised of columns 66 which are dimensioned and configured cooperatively with the spaces 48–54 of the discrete area 47 of voucher stub portions 26 to record the employee earnings data entered thereon.

The shingled checks 20 with their attached voucher stub portions 26 are retentively held in overlying registration with the journal sheet 12 by peg board member 16 which ensures the spatial correlation so that the discrete area 31 of each check 20 is aligned with the portion of columns 62 of journal sheet 12 and the discrete area 47 of each voucher stub 26 is aligned with the columns 66 of the journal sheet 12. The peg board 16 has a plurality of spaced apart upstanding peg elements 68 along one edge for retentive reception in correspondingly spaced apertures 70 of journal sheet 12 and apertures 72 of check bank 14.

Figure 2:
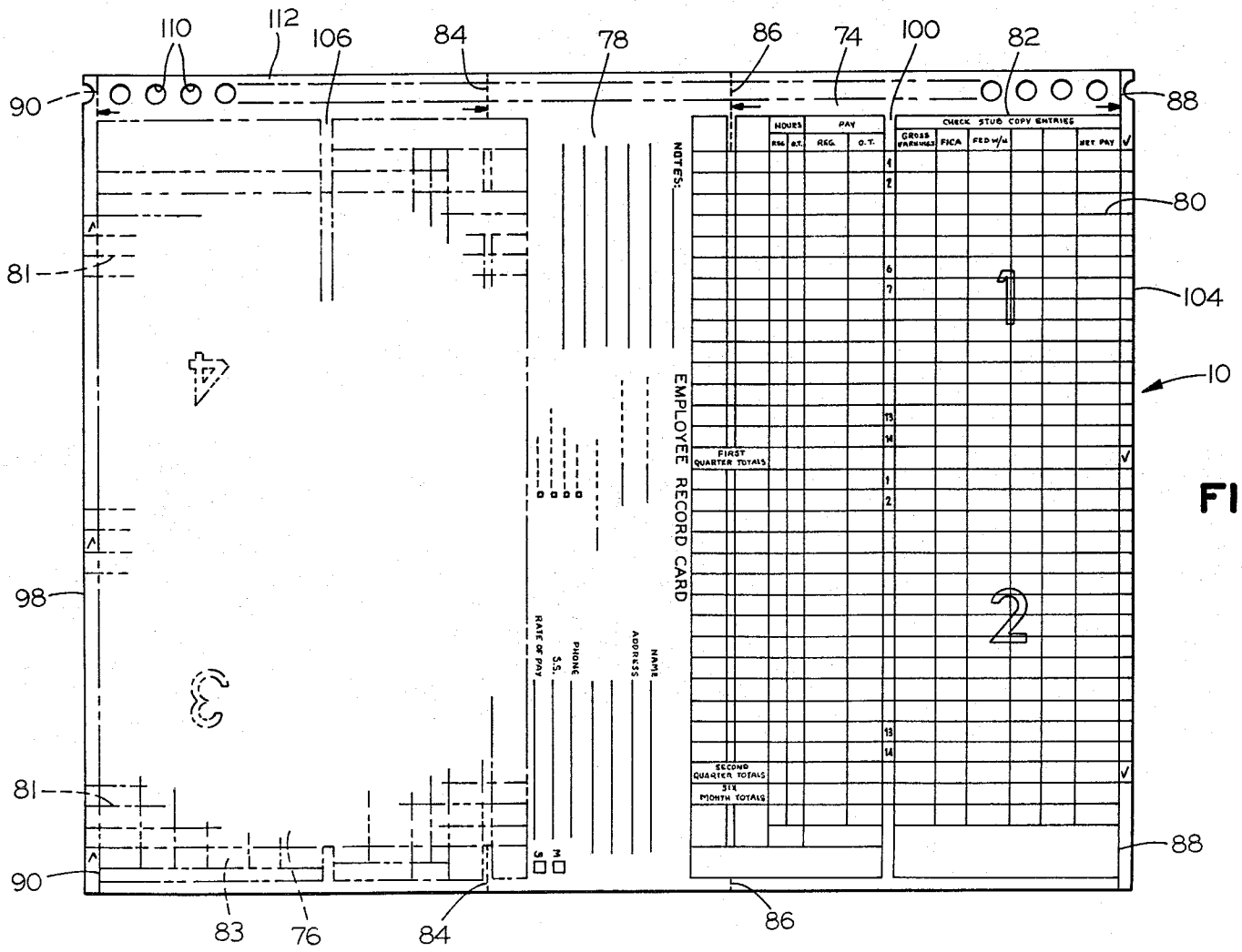
FIG. 2 is a plan view of the employee record card in an unfolded state.

In FIG. 2, the employee record card 10 is shown in a flat, unfolded position. The record card 10 is intended to record information related to an individual employee including payroll and earnings data for a full yearly period, and personnel information. It has a first section 74 along one vertical side for recording employee payroll and earnings data for a first six month period and a second section 76 along the other vertical side for recording employee payroll and earnings data for a second six month period. A middle section 78 is provided between the sections 74, 76 for the recording of employee personnel information, such as name, address, phone number, social security number, pay rate, date employed, payment period, etc.

As seen, the section 74 of record card 10 has a multiplicity of horizontal lines 80 corresponding to the lines of the journal sheet 12 and the vertical spacing of the shingled checks 20. The width dimension of section 74 is divided into a multiplicity of columns, and a portion 82 of section 74 provides a number of columns dimensioned and configured cooperatively with the voucher stub portions 26 to record the employee earnings data entered on the discrete area 47 of the voucher stubs, e.g., gross earnings, fica, withholding tax, and net amount of the check for a six month period. In the same manner, the section 76 has a multiplicity of lines 81 corresponding to the lines of the journal sheet 12 and the vertical spacing of the shingled checks 20, and a portion 84 of the section 76 has a number of columns dimensioned and configured cooperatively with the voucher stub portion 26 for recording the employee earnings data entered on the discrete area 47 of the voucher stubs during the second six month period. As seen in FIG. 2, the vertical orientation of section 74 is the reverse of the vertical orientation of section 76.

As shown in FIG. 2, a first fold line 84 extends vertically along record card 10 in spaced disposition from first section 82, and a second fold line 86 extends vertically in spaced disposition from second section 76. In utilizing the record card 10 for recording employee earnings data for a first six month period, the card 10 is folded about fold line 84; when utilizing the card for recording such data for a second six month period, the card is unfolded along fold line 84 and then folded along fold line 86. For purposes of description and explanation, record card 10 is shown in FIG. 3 folded about the fold line 84 for the recording of employee earnings data for a first six month period.

Figure 3:
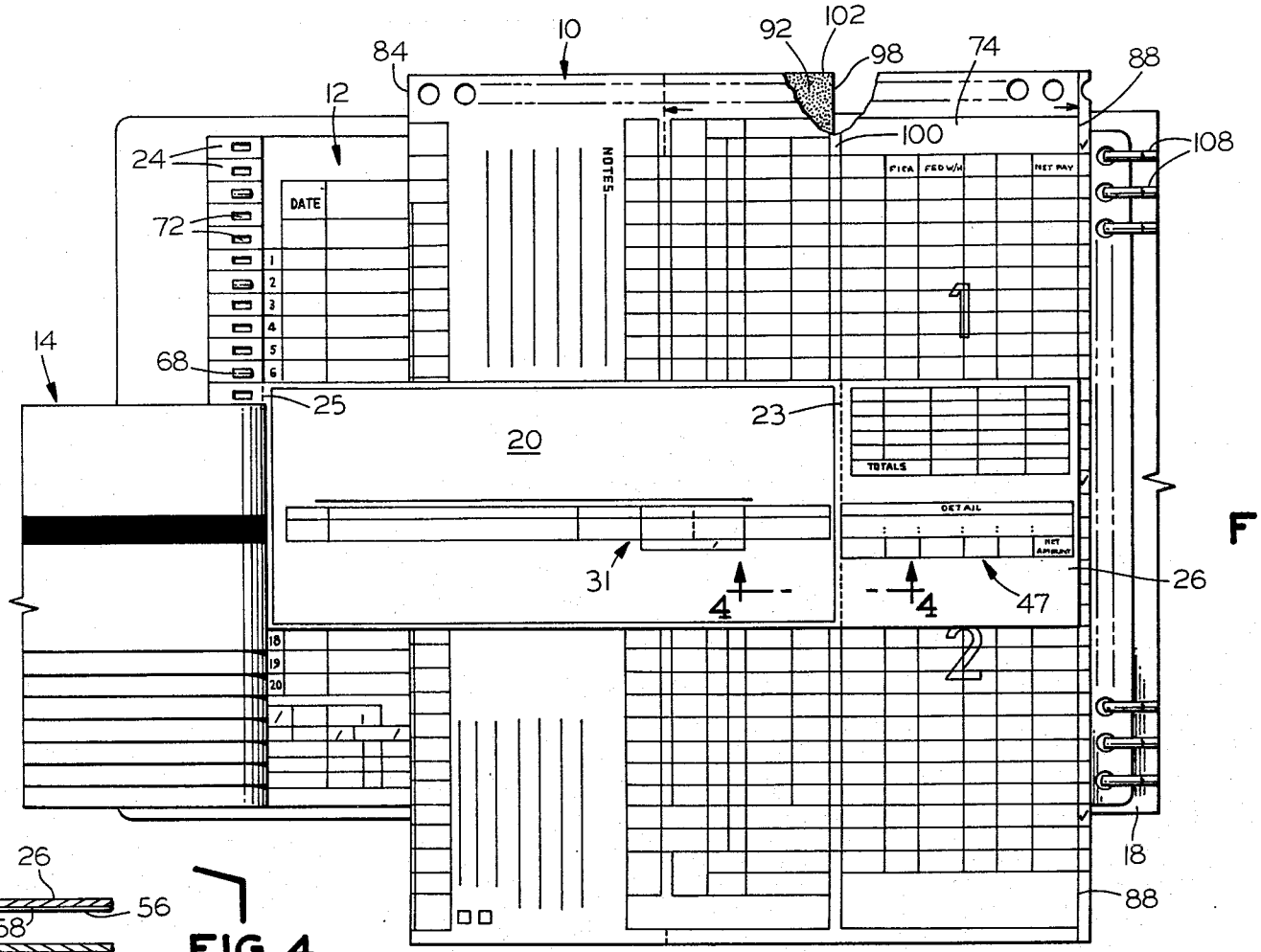
FIG. 3 is a fragmentary plan view of the ledger sheet, shingled checks and employee record card, showing the card folded about the first fold line and removably interposed between a check to be written and the disbursement and payroll journal sheet.

As seen in FIG. 3, the folded record card 10 is shown inserted between a single check 20 and journal sheet 12, and aligned for the recording of employee earnings data on the voucher stub 26. The remaining checks of check bank 14 are folded counterclockwise into an inoperative or out of the way position to allow access to the check and voucher stub portion being written. Vertical alignment of the record card 10 beneath voucher stub 26 is obtained by the registration of the outer edge of voucher stub portion 26 with a vertical alignment indicium or column line 88 located at the outer edge of section 74 of the record card 10. A corresponding alignment indicium or column line 90 is located at the outer edge of the section 76 of the record card 10 for use when record card 10 is folded about the second fold line for the recording of data for the second six month period. The horizontal alignment of the record card 10 is obtained by manual registration of the respective horizontal lines 80 adjacent the discrete area of the voucher stub portion where the entry is to be made.

Figure 4:
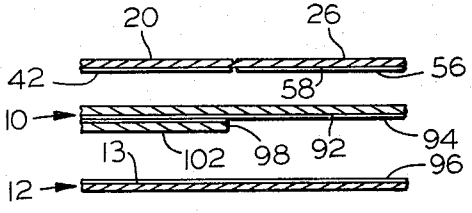
FIG. 4 is a partially diagrammatic, exploded fragmentary sectional view along line 4-4 of FIG. 3.

Turning now to FIG. 4, it can be seen that reverse surface 92 of the record card 10 has an indicia transfer means in the form of a reactant coating 94 which will react upon pressure with the reactant coating 96 on the front surface 13 of journal sheet 12 to effect an image transfer onto the underlying journal sheet 12. When pressure is applied by a pen or other like writing implement (not shown) to the record card, the reactant coatings 94, 96 will interact to produce an ink image upon the journal sheet 12. This type of transfer means is commonly referred to as a "carbonless" transfer means; exemplary is the coated paper sold by National Cash Register Company, under the trademark "NCR". Other types of transfer means may also be utilized.

As shown in the broken-away portion of FIG. 3, the vertical edge 98 of the record card 10 is aligned beneath the inner edge or boundary 100 of the portion 82 of the columns of the first section 74 of the record card 10. The "folded under" portion 102 of the record card 10 thus has a portion of the surface 92 with its reactant coating 94 facing upwardly and the other surface of the folded under portion is lying against the journal sheet 12 so as to provide a barrier to transfer of entries made on the record card 10 other than employee earnings data entered on portion 82 thereof, as will be described in more detail subsequently.

In utilizing this one-write bookkeeping and check writing system in the method for simultaneously writing a check and its voucher stub and recording the check and voucher stub data on the journal sheet, the record card 10 is folded about the fold line corresponding to the relevant six month period and is inserted between the check 20 and journal sheet 12. For purposes of illustration and explanation, the record card 10 is folded about first fold line 84, and the data is being recorded for the first six month period, as exemplified in the configuration illustrated in FIG. 3. For this configuration, the record card 10 is manually aligned so that alignment indicium 88 is in registration with the edge of the voucher stub 26 and a selected pair of horizontal lines 80 of the record card 10 is beneath the discrete area 47 of the voucher stub portion 26.

With a writing implement, the employee earnings data is entered in the appropriate spaces 48–54 of discrete area 47 of the voucher stub portion 26. Referring now to the exploded view of FIG. 4, the carbonized coating 56 on the back surface 58 of the voucher stub portion 26 causes the recorded data to be printed in the portion 82 of columns of the first section 74 of the employee record card 10. Simultaneously, the reactant coating 94 on the back surface 92 of record card 10 reacts with the reactant coating 96 on the front surface 13 of the journal sheet 12 to record the data in the columns 66 of second portion 64 of the journal sheet 10. Thus, the written entry on the voucher stub portion 26 is simultaneously recorded in the appropriate space of the employee record card 10 and in the appropriate space on the journal sheet 12.

The record card 10 is removed from between the check 20 and journal sheet 12, and the data for issuing the check is then entered with the writing implement in the appropriate spaces 32-40 of discrete area 31 of check 20. The discrete area 42 of the transfer coating on the back surface 44 of check 20 effects simultaneous imprinting of this information in the appropriate columns 62 of the portion 60 of the journal sheet 12. Alternatively, the data for issuing the check can be entered on the check 20 prior to the steps of inserting the folded employee record card 10 between the check 20 and the journal sheet 12 and entering the employee earnings data on the voucher stub portion 26.

A significant feature of this system is the barrier provided to transfer of entries on the record card 10 which are not intended to be recorded on the underlying journal sheet 12. When record card 10 is folded about fold line 84, the vertical side edge 98 is aligned under the inner edge or boundary 100 of the portion 82 of columns of the first section 74 of the record card 10 as seen in the cutaway section of FIG. 3. Thus, the reactant coating 94 on the normally back surface 92 of the folded under portion 102 is disposed against the reactant coating 94 on the back surface 92 of the remaining portion of the record card 10, as seen in FIG. 4. The normally front surface of the folded under portion 102 of record card 10 is disposed against the front surface 13 of the journal sheet 12. Since the front surface of record card 10 does not have a reactant coating thereon, the reactant coating 94 is not in contact with the reactant coating 96 of journal sheet 12 along this folded under portion 102, and any entries made on the record card above the folded under portion 102 will not be transferred to the journal sheet 12. Thus, entries on the record card 10 other than employee earnings data will not (and should not) be transferred to the underlying journal sheet 12.

During the course of the first six month period, successive lines 80 in the portion 82 of columns of the record card 10 receive the employee earnings data from the voucher stub portions 26 to provide a chronological record of the employee's earnings data. During each "one-write" entry on the voucher stub portion 26, the middle section 78 of the record card 10 is upwardly facing and easily visible to the writer. Thus, the employee personnel data is readily available to the check writer without inconvenience or disruption of the check writing and bookkeeping operation.

After the first six month period has been completed, the record card 10 is unfolded along first fold line 84 and then folded about second fold line 86 for utilization during the second six month period. The vertical orientation of the record card 10 is reversed so that section 76 of the record card 10 is compatible with the vertical orientation of journal sheet 12. The record card 10 is reinserted and aligned between the check 20 to be written and the journal sheet 12. During each "one-write" entry on the voucher stub portion 26 during the second six month period, the middle section 72 of the record card 10 is again upwardly facing and easily visible to the writer.

As seen in FIG. 1, ring binder 18 is of a generally standard bookkeeping size for journal sheets and includes a plurality of rings 108 which may be opened to receive journal sheets 12, check bank 14, peg board 16, and other bookkeeping documents 114 therein. The journal sheets 12, shingled check banks 14, and peg board member 16 are dimensioned and configured to be compatibly contained within the ring binder 18. Record card 10 is coopertatively dimensioned and configured to fit within ring binder 18 when the record card 10 is folded about either one of the fold lines 84 and 86. A row of apertures 110 extends along the upper edge 112 of the record card 10 for mounting on the rings 108 of the ring binder 18. This allows all bookkeeping and check writing documents to be conveniently carried in one binder.

Although the illustrated assembly utilizes a peg board member 16 to hold the shingled checks 20 in overlying registration with the journal sheet 12, other types of spatial correlation means may be utilized to obtain the retentive registration of checks 20 with journal sheet 12.

Additionally, transfer means other than the reactively coated paper may be utilized for transfer of data from the employee record card to the journal sheet 12 such as a carbon coating in the rear surface of employee record card.

Thus, it can be seen that this one-write bookkeeping and check writing system for disbursement and payroll checks accomplishes the simultaneous entry of employee earnings data onto the voucher stub and onto both the underlying journal sheet 12 and the employee record card 10. Further, the employee record card 10 allows the recording of employee earnings data for a full yearly period. The record card 10 functions to transfer employee earnings data to the underlying documents and provides a barrier to the transfer of information other than employee earnings data. The system is also relatively simple to fabricate and utilize, and conveniently fits into a standard ring binder.

Having thus described the invention, what is claimed is:

1. In a one-write bookkeeping and check writing system adapted to record payroll and other information, the combination comprising:

A. a bank of shingled commercial checks each having a body portion and a detachable payroll voucher stub portion at one side thereof and a front surface and a back surface, each of said checks having a discrete area on the front surface of said body portion thereof for entry of at least the name of the payee and the amount of the check and at least a corresponding discrete area of an indicia transfer coating on its back surface, each of said voucher stub portions having a discrete area on said front surface for entry of employee earnings data and at least a corresponding discrete area of an indicia transfer coating on said back surface;

B. a disbursement and payroll journal sheet underlying said bank of checks and having length and width dimensions, the width dimension being divided into a multiplicity of columns and the length dimension being divided into a multiplicity of lines, said journal sheet having a first portion of said columns dimensioned and configured cooperatively with said commercial checks to record at least the name of the payee and the amount entered on the check, said journal sheet having a second portion of said columns dimensioned and configured cooperatively with said payroll voucher stub portions to record employee earnings data;

C. spatial correlation means detachably mounting said journal sheet and said bank of checks in overlying relationship with said discrete area of said checks in alignment with said first portion of said columns of said journal sheet and said discrete area of said voucher stub portions in alignment with said second portion of said columns of said journal sheet; and D. an employee record card for entry of employee related information including employee earnings data for a yearly period, said card being removably interposed between said journal sheet and said bank of checks, the front surface of said employment record card having a first section along one side thereof for recording employee earnings data for a first six month period, a second section along the other side thereof for recording employee earnings data for a second six month period, and a middle section for entry of employee personnel information, said first and second sections each having a multiplicity of lines corresponding to the lines of said journal sheet and the vertical spacing of the shingled checks and at least a portion of the width providing a multiplicity of columns dimensioned and configured cooperatively with said voucher stubs to record employee earnings data entered on the voucher stubs, said record card being folded along a first vertical fold line spaced from said first section to interpose a folded under portion between the remainder of the card other than said first section and the journal sheet, a second vertical fold line located along a line spaced from said second section, said card including means for aligning the columns of said first section thereof in overlying registration with the second portion of said columns of said journal sheet and being so aligned, said card further including means for aligning the columns of said second section thereof in overlaying registration with the second portion of said columns of said journal sheet when said record card is unfolded along said first fold line and folded about said second fold line, said card further having indicia transfer means on the back surface thereof for transferring the employee earnings data entered on said discrete area of said voucher stub to said second portion of said columns of said journal sheet, said folded under portion of said card disposing a portion of the front surface of the folded card against said journal sheet to prevent transfer to said journal sheet of entries on said record card other than said employee earning data entered on said discrete area of said voucher stub, whereby the entry of employee earnings data on the discrete area on the front surface of a selected voucher stub is simultaneously recorded on said record card within said columns of said first section of said record card and on said journal sheet sheet within said second portion of said columns of said journal sheet.

2. The combination of claim 1 wherein said first fold line is spaced from said middle section of said record card so that said middle section and said first section face upwardly toward said check.

3. The combination of claim 2 wherein said second fold line is spaced from said middle section of said record card so that said middle section and said second section face upwardly toward said bank of checks when said record card is unfolded about said first fold line and folded about said second fold line and removably inserted and aligned between said bank of checks and said journal sheet.

4. The combination of claim 1 wherein said record card has first and second opposing vertical side edges, said portion of said first section of said record card having a multiplicity of columns is bounded by inner and outer vertical edge boundaries, and said first edge of said record card is aligned with said inner edge boundary of said portion of said first section.

5. The combination of claim 4 wherein said portion of said second section of said record card having a multiplicity of columns is bounded by inner and outer vertical edge boundaries, and said second edge of said record card is aligned with said inner edge boundary of said second section when said record card is unfolded along said first fold line and folded about said second fold line.

6. The combination of claim 1 further including a ring binder with said spatial correlation means, said journal sheet, and said bank of checks each being dimensioned and configured cooperatively with respect thereto and having apertures along one edge thereof through which the rings of said binder extend, and said employee record card being dimensioned and configured to conform to said binder when said card is folded about one of said fold lines.

7. The combination of claim 1 wherein said indicia transfer coatings on said checks and on said voucher stub portions are carbon coatings.

8. The combination of claim 1 wherein said indicia transfer means on said back of said record card is a carbonless transfer coating.

9. The combination of claim 1 wherein said indicia tranfer means on the back surface of said record card comprises a first reactant coating and said front surface of said journal sheet has a cooperating reactant coating with said reactant coatings being activated by the pressure of a writing implement to transfer the data entered on the voucher stub onto the journal sheet.

10. The combination of claim 1 wherein said spatial correlation means comprises a pegboard having a column of upstanding peg elements extending along one side edge, and said journal sheet and said bank of shingled checks each having a corresponding column of apertures through which said pegs extend.

11. The combination of claim 1 wherein said means for aligning the columns of said first section comprises a first alignment indicium on said record card manually aligned with the edge of said voucher stub portion spaced from the body portion of said checks when said record card is folded about said first fold line, and said means for aligning the columns of said second section comprises a second alignment indicium on said record card to be manually aligned with said edge of said voucher stub portions when said record card is folded about said second fold line.

12. The combination of claim 11 wherein said record card has first and second opposing edges and said first alignment indicium is located adjacent said first edge and said second alignment indicia is located adjacent said second edge.

13. A bookkeeping method for simultaneously writing a check and recording selected voucher data on both a disbursement and payroll journal sheet and also on an employee record card, comprising the steps of:

A. providing a bank of shingled checks, each having a body portion and a laterally adjacent voucher stub portion, and having discrete area transfer means on the back surface thereof;

B. providing a disbursement and payroll journal sheet having a columnar check portion and a laterally adjacent columnar voucher portion thereon, the relative positions of said columnar portions corresponding to the relative positions of said body and voucher stub portions of said checks;

C. providing an employee record card for entry of employee related information on the upper surface thereof, including selected voucher stub portion data for a yearly period, said card having on its upper surface a first columnar section dimensioned to correspond to the voucher stub portions of said checks for recording such selected voucher portion data for one six month period, a middle section for entry of employee personnel information, and a second columnar section dimensioned to correspond to the voucher stub portions for recording selected voucher stub portion data for another six month period, said card having indicia transfer means on the back surface thereof;

D. non-symmetrically folding said employee record card rearwardly about a first fold line, so as to dispose the folded under portion beneath the remainder of said card other than said first section;

E. positioning said bank of checks in overlying registration with said journal sheet to align said body portions and stub portions of said checks with said columnar check portion and voucher portion of said journal sheet, respectively;

F. positioning said folded record card between said bank of checks and said journal sheet with the upper surface thereof upwardly disposed, and aligning said first columnar section of said card beneath said voucher stub portions thereof;

G. entering selected data on said voucher stub portion of one of said checks with a writing implement, such selected data being simultaneously recorded on the first columnar section of said record card and transferred to the columnar voucher portion of said journal sheet by the discrete area transfer means on said voucher stub portion and the indicia transfer means on said voucher stub portion and the indicia transfer means on the back surface of said card, respectively; and H. optionally entering additional data on said remainder of said record card other than said first section thereof, said folded under portion of said record card providing a barrier to the transfer of such additional data to said journal sheet.

14. The method of claim 13 including the step of removing said folded record card from between said check and journal sheet after the step of entering selected data on said voucher stub portion with a writing implement.

15. The method of claim 14 including the step of maintaining said check in overlying direct registration with said journal sheet and then entering selected data on said check.

16. The method of claim 14 including the steps of unfolding and non-symmetrically refolding said employment record card rearwardly about a second fold line, so as to dispose a second folded under portion beneath the remainder of said card other than said second columnar section thereof, and inserting said folded card between said checks and journal sheet for entry of selected voucher stub portion data in said second section in further writing of checks.

17. The method of claim 13 including the step of displacing all of said shingled checks into an inoperative position spaced from said employee record card and said journal sheet except the check intended to be written.

* * * * *

UNITED STATES PATENT AND TRADEMARK OFFICE

CERTIFICATE OF CORRECTION

PATENT NO. : 4,465,306

DATED : August 14, 1984

INVENTOR(S) : Robert W. Hincks and Daniel A. Hincks

It is certified that error appears in the above—identified patent and that said Letters Patent is hereby corrected as shown below:

Column 10, line 36, delete "sheet" second occurrence.

Column 12, lines 29-30, delete "on said voucher stub portion and the indicia transfer means".

Signed and Sealed this

*Thirtieth* Day of *April 1985*

[SEAL]

*Attest:*

DONALD J. QUIGG

*Attesting Officer*

*Acting Commissioner of Patents and Trademarks*